US007383885B2

(12) United States Patent
Bergeron et al.

(10) Patent No.: US 7,383,885 B2
(45) Date of Patent: Jun. 10, 2008

(54) FLOATATION MODULE AND METHOD

(75) Inventors: Billy James Bergeron, Arnaudville, LA (US); William von Eberstein, 132 Ayshire Ct., Slidell, LA (US) 70461

(73) Assignee: William von Eberstein, Slidell, LA (US)

( * ) Notice: Subject to any disclaimer, the term of this patent is extended or adjusted under 35 U.S.C. 154(b) by 151 days.

(21) Appl. No.: 10/946,798

(22) Filed: Sep. 22, 2004

(65) Prior Publication Data

US 2006/0062638 A1 Mar. 23, 2006

(51) Int. Cl.
*E21B 17/00* (2006.01)

(52) U.S. Cl. ..... 166/345; 405/171

(58) Field of Classification Search ..... 405/211, 405/212, 215, 216, 224.2, 158, 169, 171, 405/172; 166/345, 348, 350; 114/243
See application file for complete search history.

(56) References Cited

U.S. PATENT DOCUMENTS

| | | | | |
|---|---|---|---|---|
| 3,729,756 | A | 5/1973 | Cook et al. | |
| 3,768,842 | A | 10/1973 | Ahlstone | |
| 3,858,401 | A | 1/1975 | Watkins | |
| 4,086,971 | A * | 5/1978 | Hall et al. | 175/7 |
| 4,437,791 | A * | 3/1984 | Reynolds | 405/224.2 |
| 4,445,806 | A * | 5/1984 | Crain | 405/216 |
| 4,477,207 | A * | 10/1984 | Johnson | 405/195.1 |
| 4,596,531 | A | 6/1986 | Schawann et al. | |
| 4,829,923 | A * | 5/1989 | Copson et al. | 114/27 |
| 5,117,915 | A | 6/1992 | Mueller et al. | |
| 5,181,571 | A | 1/1993 | Mueller et al. | |
| 5,330,294 | A | 7/1994 | Guesnon | |
| 5,676,209 | A | 10/1997 | Reynolds | |
| 5,860,478 | A * | 1/1999 | Coutts et al. | 166/356 |
| 6,155,748 | A | 12/2000 | Allen et al. | |
| 6,270,387 | B1 | 8/2001 | Nesheim | |
| 6,443,244 | B1 | 9/2002 | Collins | |
| 6,488,447 | B1 | 12/2002 | Nish et al. | |
| 6,505,685 | B1 | 1/2003 | Sullaway et al. | |
| 2001/0027878 | A1 | 10/2001 | Roberts et al. | |
| 2001/0030045 | A1 | 10/2001 | Roberts et al. | |
| 2003/0026663 | A1 | 2/2003 | Guesnon et al. | |
| 2003/0070814 | A1 | 4/2003 | Sullaway et al. | |
| 2003/0070815 | A1 | 4/2003 | Sullaway et al. | |
| 2003/0070816 | A1 | 4/2003 | Sullaway et al. | |
| 2004/0182611 | A1 * | 9/2004 | Ramey et al. | 175/423 |

* cited by examiner

*Primary Examiner*—Sunil Singh
(74) *Attorney, Agent, or Firm*—Robert L. Waddell; Ted M. Anthony

(57) ABSTRACT

An apparatus for reducing the load applied to a rig. The rig is positioned over a well, with the well having a tubular string disposed therein. A landing string is connected to the tubular string such as casing, production and/or testing assemblies. The apparatus comprises a floatation module attached to the landing string and a clamp for clamping the floatation module onto the landing string. In one embodiment, the floatation module comprises a tubular sleeve having a buoyant material applied thereto. The tubular sleeve includes slots. The clamp may contain a set of dies adapted to engage the slots of the tubular sleeve. A method of landing a work string into a sub-sea well head from a floating drilling rig is also disclosed, wherein a marine riser connects the rig to the sub-sea well head.

9 Claims, 7 Drawing Sheets

118
116
130
110
122
132
134
126
136
122
124
120
114
112

FLOATATION MODULE AND METHOD

BACKGROUND OF THE INVENTION

This invention relates to a floatation module and method of using the floatation module. More particularly, but not by way of limitation, this invention relates to a floatation module and method for safely reducing the rig hoisting requirements to run tubular strings into sub-sea wells and well bores.

As the energy industry continues to search the globe for hydrocarbon reservoirs, the search has increasingly focused in the world's oceans. Economical hydrocarbon reservoirs are increasingly being discovered and developed in deep water tracts located in remote and exotic places on the planet. Floating drilling platforms, such as mobile offshore drilling units (MODU's), are anchored in water depths of more than 9,200 feet and are dynamically positioned in water depths greater than 10,000 feet.

In combination with this deep water drilling, the actual wells drilled are in increasingly deeper water in order to penetrate commercially feasible hydrocarbon reservoirs. Hence, these wells can exceed 34,000 feet in depth. The equipment required to safely drill ultra deep water wells is large, extremely heavy, and difficult to safely handle. As understood by those of ordinary skill in the art, the lifting and lowering capacity of the drilling rigs, including MODU's, are loaded to the maximum safe working loads.

For instance, if an operator is running a casing string into a well bore to a sub-sea wellhead, the operator is required to lift out of the casing slips then lower that proper amount of casing. However, the operator will also be required to pick-up and lower a landing string in combination with the casing, and wherein the ultimate length of the landing string will be basically equal to the distance between the rotary table and sub-sea well head at the sea floor. Therefore, the combined weight of the casing string and the landing string could push the safe hoisting and drill pipe slip's capacity of the MODU to its maximum designed safe working loads.

The landing string is specifically designed to provide the very high tensile strengths (now rated to 1,500,000 lbs. working load) to safely land out casing in the sub-sea well head. As the water depth increases, the length and weights of the landing string increase proportionateley. Existing MODU's are now operating at or near their maximum hoisting capabilities with loads of 1,500,000 to 2,000,000 pounds. Casing loads of 1,500,000 pounds translate to dynamic loads of 1,750,000 lbs or more (depending on hole condition, fluid characteristics, casing designs, friction) when picking up out of the slips. In some cases, this exposes the entire load path/hoisting system (top drive, subs, crown sheaves, derrick, slips and brakes) to maximum loading.

Numerous problems involving drill pipe slip crushing and catastrophic slip failures have occurred which have required new heavier designs that even now barely meet load requirements. Loading the hoisting system to the maximum of its design creates several safety concerns including, but not limited to: special landing strings being designed that are heavier wall, which further exacerbates the load handling requirements; rig hoisting system capability to safely handle extreme loads (static/dynamic); the rig's capability to safely apply over-pull in tight hole conditions; the requirement of inspection of hoisting and braking system prior to the job; and dynamic loads which reach and/or exceed safe working capabilities.

A prior art technique, known as floating, is sometimes used to reduce casing loads during running. The floating technique entails running the casing without completely filling the entire length with fluid, therefore establishing buoyancy due to the air inside. This presents several concerns for operations, equipment, and the health and safety of the rig crew. For instance, some of the problems encountered include: extremely high differential pressures on float equipment; failure of float equipment could cause immediate overloading of rig hoisting system caused by loss of buoyancy, which would be catastrophic; well control and/or stuck pipe due to swabbing or suction if floats fail; casing collapse; and, removal of air in casing effects circulation and cementation of the casing.

Therefore, there is a need for an apparatus and method for running and landing casing from floating drilling platforms. There is also a need for a device and method that can reduce the rig hoisting requirements to safely run casing strings from floating drilling platforms. These as well as many other needs will be met by the invention herein disclosed.

SUMMARY OF THE INVENTION

An apparatus for reducing the load applied to a rig. The rig being positioned over a well, with the well having a tubular string disposed therein. A landing string is connected to the tubular string, such as casing or production equipment. The apparatus comprises a floatation module attached to the landing string and a clamp means for clamping the floatation module onto the landing string. Also included is engagement means, located on the floatation module, for engaging with the clamp means.

In one preferred embodiment, the floatation module comprises a tubular sleeve having buoyant material applied thereto. The engagement means includes slots formed in the tubular sleeve. In the most preferred embodiment, the tubular sleeve is constructed of aluminum and the buoyant material comprises a foam bonded to the aluminum sleeve.

Also in the most preferred embodiment, the tubular sleeve comprises a first cylindrical half body pivotly attached to a second cylindrical half body. The clamp means further includes a first shell attached to a second shell, and wherein said first shell and said second shell are pivotly attached to form a cylindrical member. The clamp means may further comprise a first set of dies adapted to engage the slot of the first tubular.

In one embodiment, a second floatation module is attached to the landing string and wherein the clamp means further comprises a second set of dies adapted to engage a slot located in the second floatation module. In the preferred embodiment, the first shell comprises a latching rod and the second shell comprises a latching protrusion and wherein the latching rod is configured to engage the latching protrusion in order to latch the first shell and the second shell together.

A method of landing a tubular string, such as casing or production equipment, into a sub-sea well head from a floating drilling rig onto a sub-sea well head is also disclosed, wherein a marine riser connects the rig to the sub-sea well head. In the preferred embodiment, the tubular string is a casing string. The method comprises running the casing string into the marine riser, and connecting a casing hanger to the casing string. Next, a landing string is attached to the casing hanger. A floatation module is connected to the landing string.

The method further includes lowering the landing string through the marine riser so that the weight of the tubular string being lowered into the marine riser is reduced. The casing hanger can then be landed into the sub-sea well head.

In one preferred embodiment, the floatation module comprises a tubular member having a buoyant material bonded thereto, a slot formed within the tubular member, and engagement means for engaging with the slot and the step of attaching the floatation module to the landing string includes attaching the engagement means with the slot in order to clamp the floatation module with the landing string. Also, the engagement means may comprise a die member and wherein the step of attaching the engagement means further includes engaging the die member into the slot.

An advantage of the present invention includes an apparatus and method that safely reduces rig hoisting requirements. Another advantage is that the invention is safer than prior art methods and devices. Yet another advantage is that an operator can install floatation modules before going to the rig site, or can install at the rig site. Another advantage is the modularity of the invention. For instance, an operator can install several floatation modules per joint of pipe, or alternatively, the operator can space out floatation modules in a predetermined sequence along the entire length of the landing string in order to effect the desired amount of buoyancy.

A feature of the invention is that the buoyancy material, such as syntactic foam, is bonded to a sleeve, such as an aluminum sleeve. Another feature is that the sleeve consist of two cylindrical halves that are latched together to form the floatation module. A feature is the clamp means for clamping the halves together. Yet another feature is that the sleeve can contain engagement means that comprises slots. Another feature is that the clamp means includes dies that engage with the slots thereby holding the sleeves about the landing string.

DETAILED DESCRIPTION OF THE PREFERRED EMBODIMENTS

Figure 1:
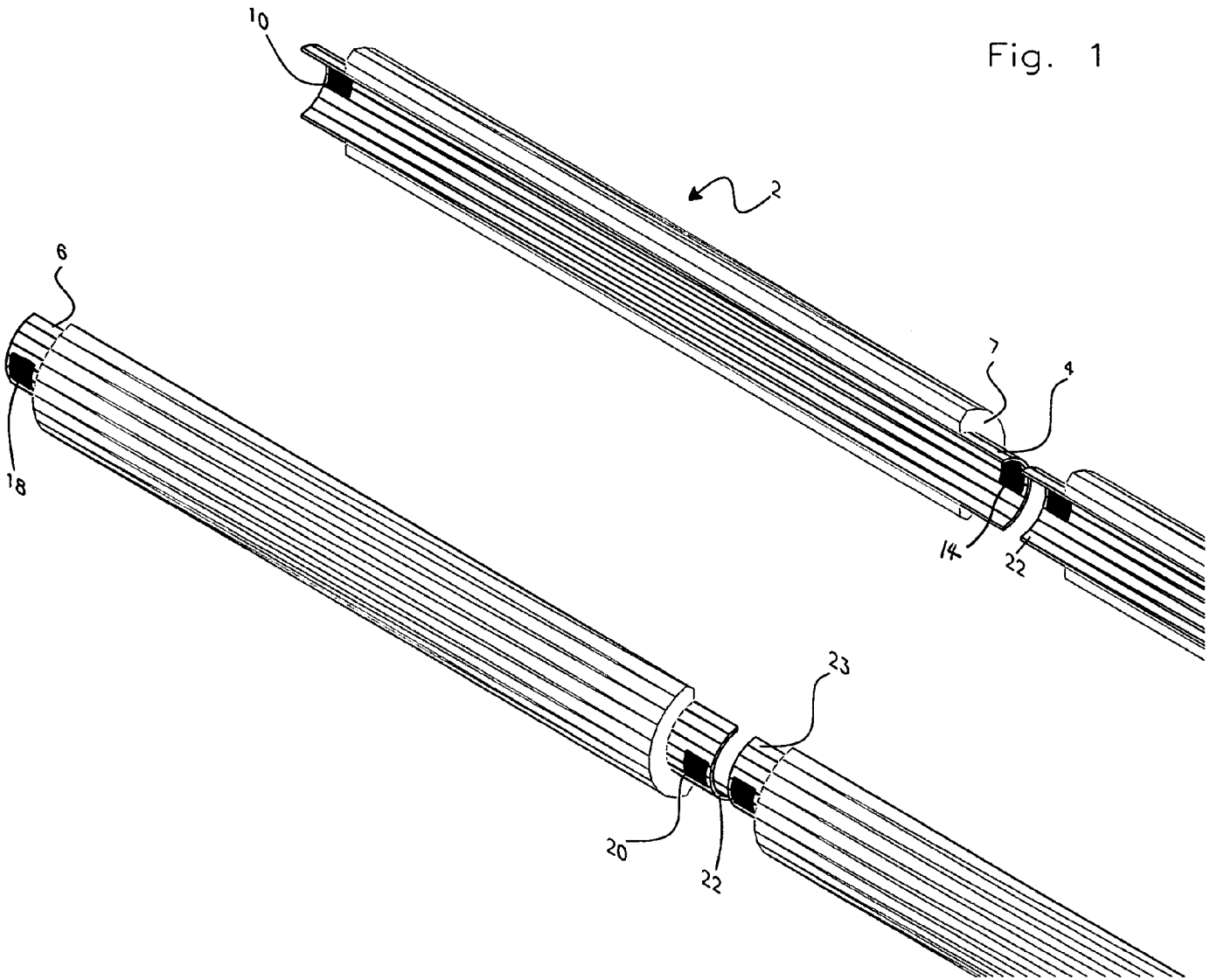
FIG. 1 is an isometric view of the floatation module of the present invention in the open position.

Referring to FIG. 1, an isometric view of the floatation module 2 of the present invention in the open position will now be described. As seen in FIG. 1, the floatation module 2 contains a first half cylindrical sleeve 4 and a second half cylindrical sleeve 6. A cylindrical member is formed when the first half cylindrical sleeve 4 and second half cylindrical sleeve are joined together. In the most preferred embodiment, the first half tubular sleeve 4 and the second half tubular sleeve 6 are constructed of aluminum.

A buoyant material will be bonded to the first half cylindrical sleeve 4 and the second half cylindrical sleeve 6. In the most preferred embodiment, the buoyant material is a syntactic foam commercially available from CRP Corporation under the name Syntactic Foam. For instance, the 3 bonded foam, which is bonded to the sleeve 4, is seen generally at 7.

FIG. 1 also shows that the first half cylindrical sleeve 4 has means for engaging with a clamp, wherein the clamp will be explained with reference to FIG. 2. Returning to FIG. 1, for the first half cylindircal sleeve 4, the engaging means includes slot 10 formed on a first end of the first half cylindrical sleeve 4, and the slot 14 formed on a second end of the first half cylindrical sleeve 6. For the second half cylindrical sleeve 6, the engaging means includes slot 18 on a first end of the second half cylindrical sleeve 6, and the slot 20 formed on the second end of the second half cylindrical sleeve 6. In the most preferred embodiments, the slots are rectangular in shape. FIG. 1 also shows a third half cylindrical sleeve 22 and a fourth half cylindrical sleeve 23.

Figure 2:
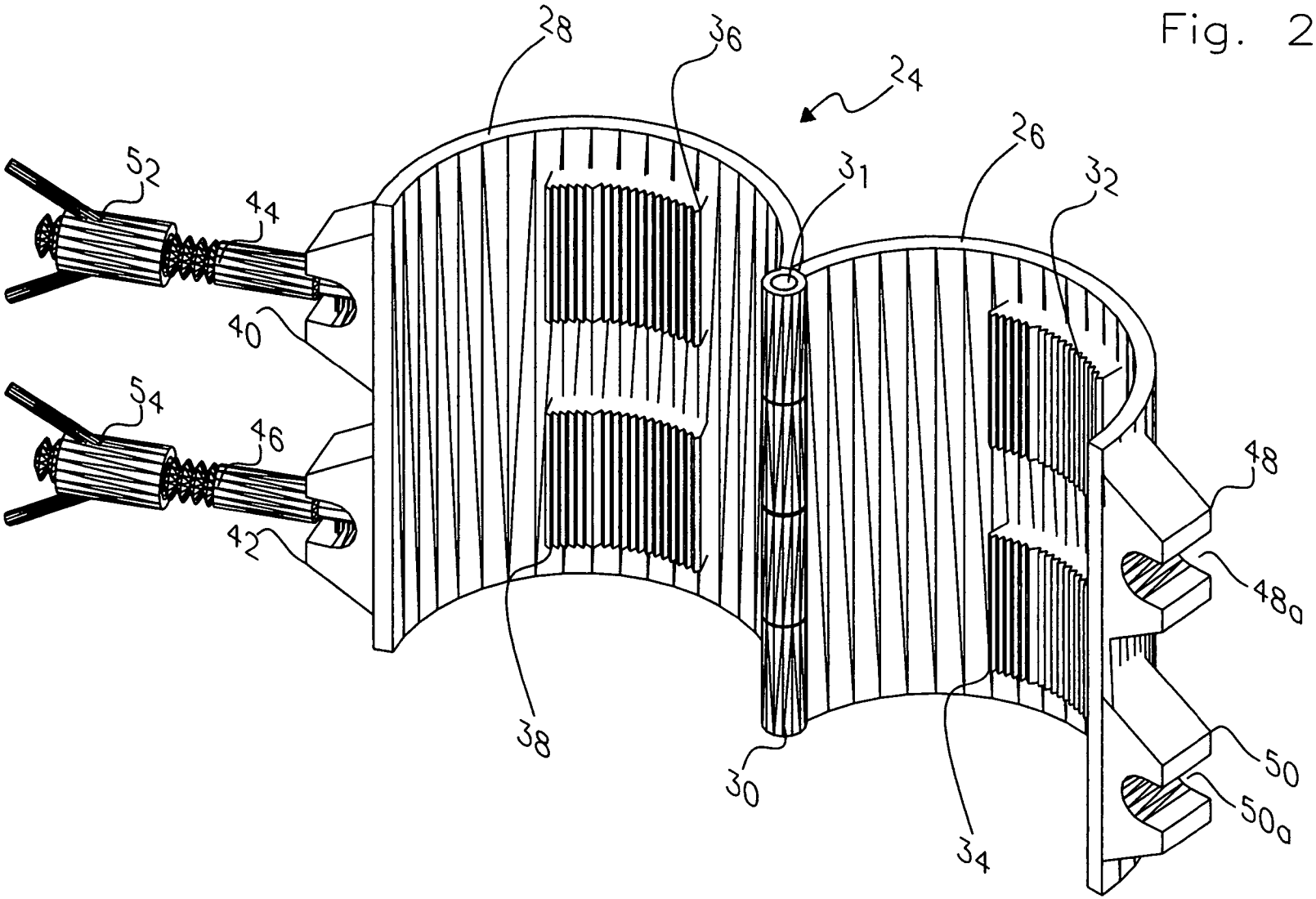
FIG. 2 is an isometric view of the clamp means of the present invention in the open position.

Referring now to FIG. 2, an isometric view of the clamp means 24 of the present invention in the open position is shown. The clamp means 24 contains a first half cylindrical shell 26 and a second half cylindrical shell 28 that pivotly attached via the hinge means 30. In the preferred embodiment shown in FIG. 2, the hinge means 30 is a conventional type of hinge having a rod 31 extending through cylindrical bodies.

FIG. 2 also depicts that the clamp means 24, and in particular the member 26, contains a first die 32 and a second longitudinally spaced die 34, wherein the dies are protrusions fixed on the inner portion of the shell 26. The shell 28 contains the third die 36 and a fourth longitudinally spaced die 38, wherein the dies are protrusions fixed on the inner portion of the member 28. In the most preferred embodiment, the dies are rectangular, formed on the inner portion of the shells 26, 28, and are configured to engage the slots formed on the sleeves of the floatation modules.

FIG. 2 also shows a pair of mounting brackets, namely mounting bracket 40 and mounting bracket 42. The mounting brackets 40, 42 will have rods 44, 46, respectively, that are pinned to the mounting brackets 40, 42. The rod 44 is configured to cooperate and engage with the receiving bracket 48, wherein the receiving bracket 48 is attached to the first half shell 26. The recieving bracket 48 has the cavity 48*a* configured to receive the rod 44. The rod 46 is configured to cooperate and engage with the receiving bracket 50, wherein the receiving bracket 50 is attached to the first half cylindrical member 26. The receiving bracket 50 has the cavity 50*a* configured to receive the rod 46. The rod 44 will have nut member 52 that will engage external thread means on the rod 44, wherein the nut member 52 will fasten the members 26, 28 together. Also, the rod 46 will have nut member 54 that will engage external thread means on the rod 46, wherein the nut member 54 will fasten the members 26, 28 together.

Figure 3:
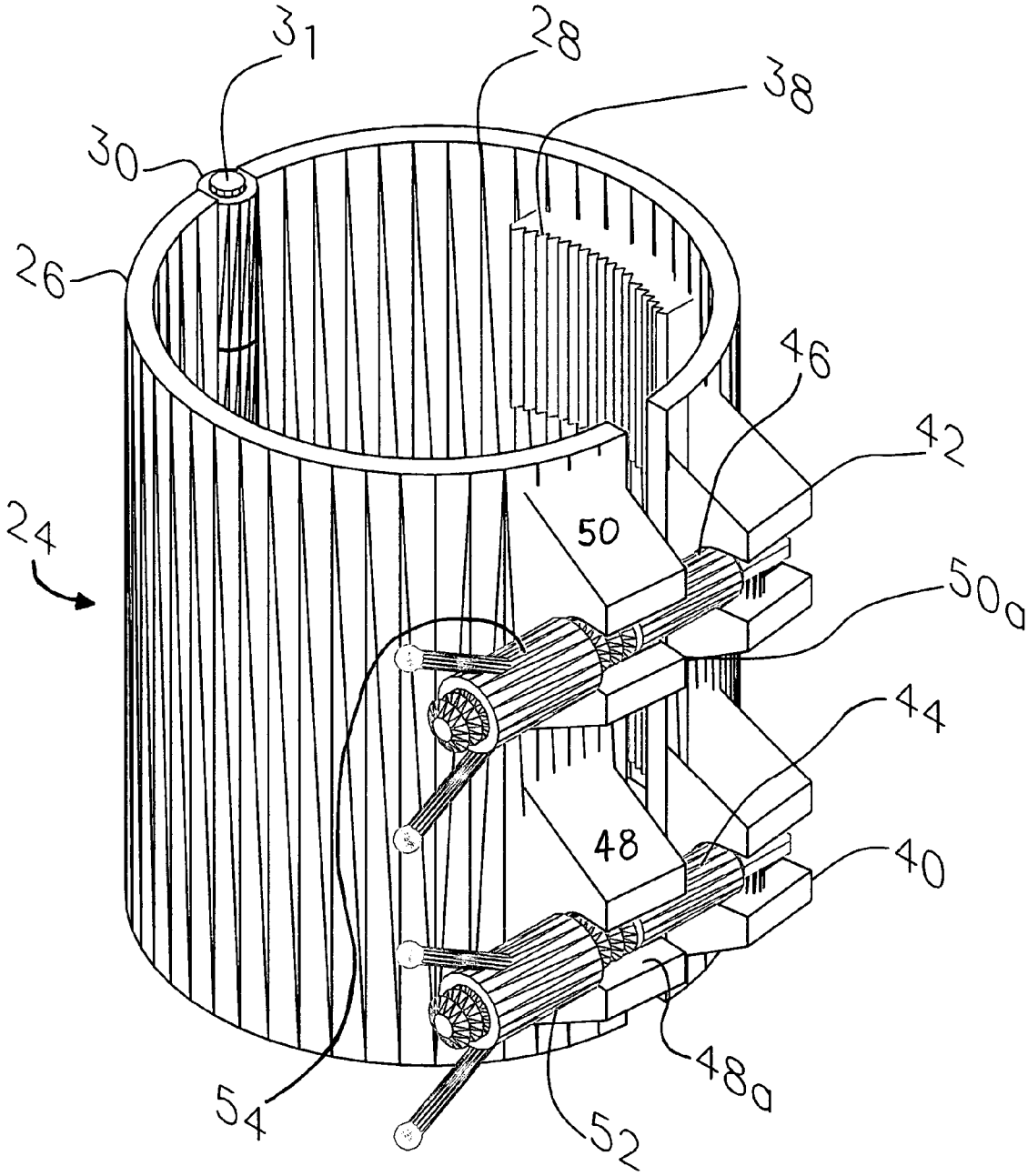
FIG. 3 is an isometric view of the clamp means seen in FIG. 2, with the clamp means in the closed position.

Referring now to FIG. 3, an isometric view of the clamp means 24 seen in FIG. 2, with the clamp means 24 being in the closed position will now be described. It should be noted that like numbers appearing in the various figures will refer to like components. The members 26, 28 have been pivoted closed via the hinge 30. The rod 44 pivots to engage the receiving bracket 48 within cavity 48*a*, and the rod 46 pivots to engage the receiving bracket 50 within cavity 50*a*. The nut members 52, 54 can then be turned to fasten the clamp means 24.

Figure 4:
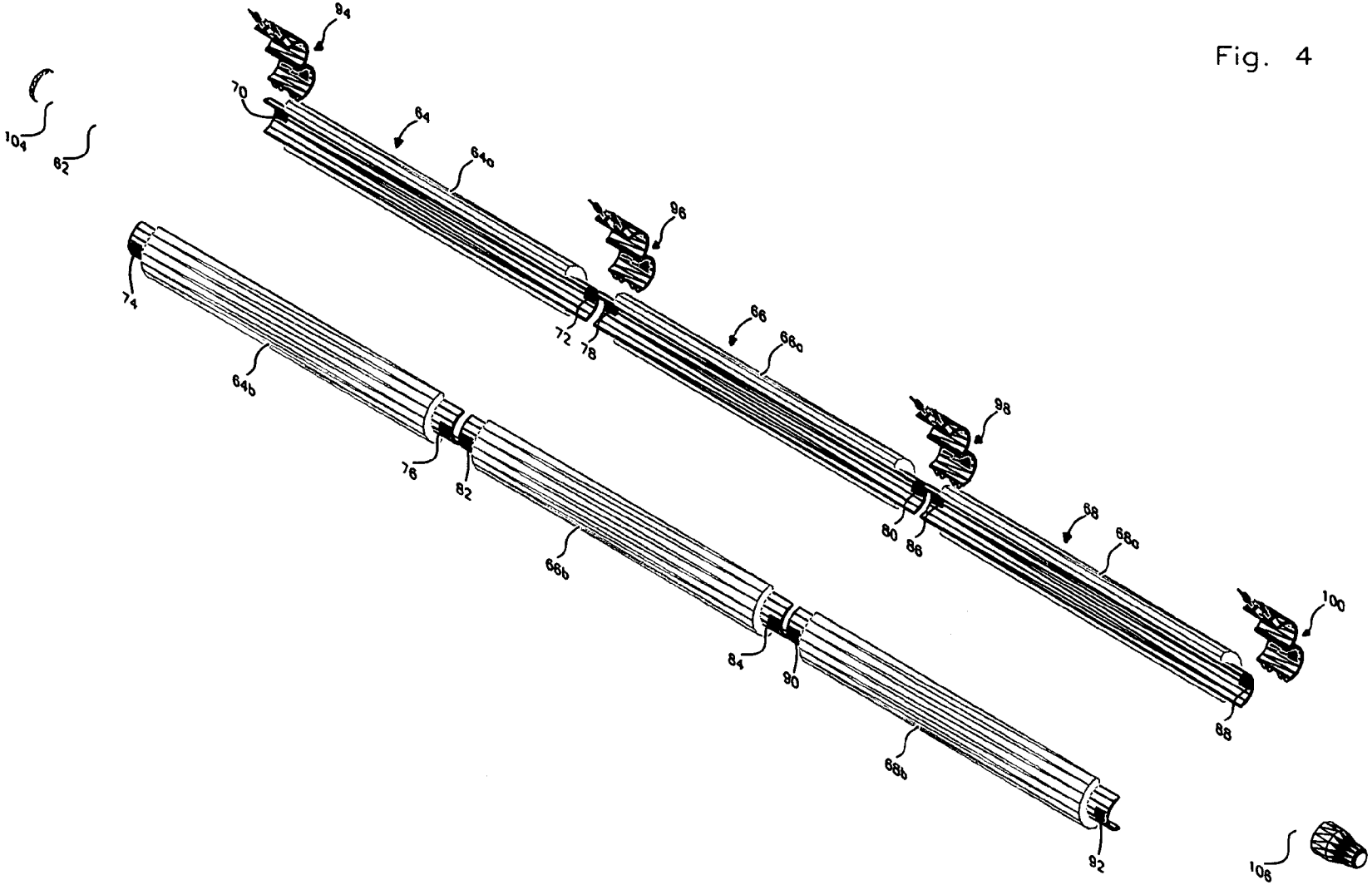
FIG. 4 is an isometric exploded view of the floatation modules about a joint of landing string.

FIG. 4 is an isometric exploded view of a plurality of floatation modules about a joint of landing string 62. More specifically, FIG. 4 shows a first floatation module 64 that consist of a first half sleeve 64*a* and a second half sleeve

64*b*; a second floatation module 66 that consist of a first half sleeve 66*a* and a second half sleeve 66*b*; and, a third floatation module 68 that consist of a first half sleeve 68*a* and a second half sleeve 68*b*. The sleeve 64*a* has slots 70, 72; the sleeve 164*b* has slots 74, 76; the sleeve 66*a* has slots 78, 80; the sleeve 66*b* has slots 82, 84; the sleeve 68*a* has slots 86, 88; and, the sleeve 68*b* has slots 90, 92. In the most preferred embodiment, the sleeves 64*a*, 64*b*, 66*a*, 66*b*, 68*a*, and 68*b* comprise the aluminum sleeve with the bonded foam, as previously described.

Also shown in FIG. 4 are the clamp means. The clamp means 94 will engage the floatation module 64, and in particular, the slots 70, 74 via the dies of clamp means 94. The clamp means 96 will engage the floatation modules 64 and 66, and in particular, the slots 72, 76 and slots 78, 82 via the dies of clamp means 96. The clamp means 98 will engage floatation modules 66 and 68, and in particular, the slots 80, 84 and slots 86, 90 via the dies of clamp means 98. The clamp means 100 will engage the floatation module 68, and in particular the slots 88, 92 via the dies of clamp means 100.

The landing string 62 has box end 104 and a pin end 106. It should be noted that while three floatation modules have been shown, the actual number placed per joint can vary. In fact, with some landing strings, it is possible to alternate the placement of the floatation modules amongst various joints. The actual number, length of the floatation modules, thickness of the buoyant material, etc. will depend on specific design criteria. Many design criteria can be considered, such as the amount weight reduction required, rig space, etc.

Figure 5:
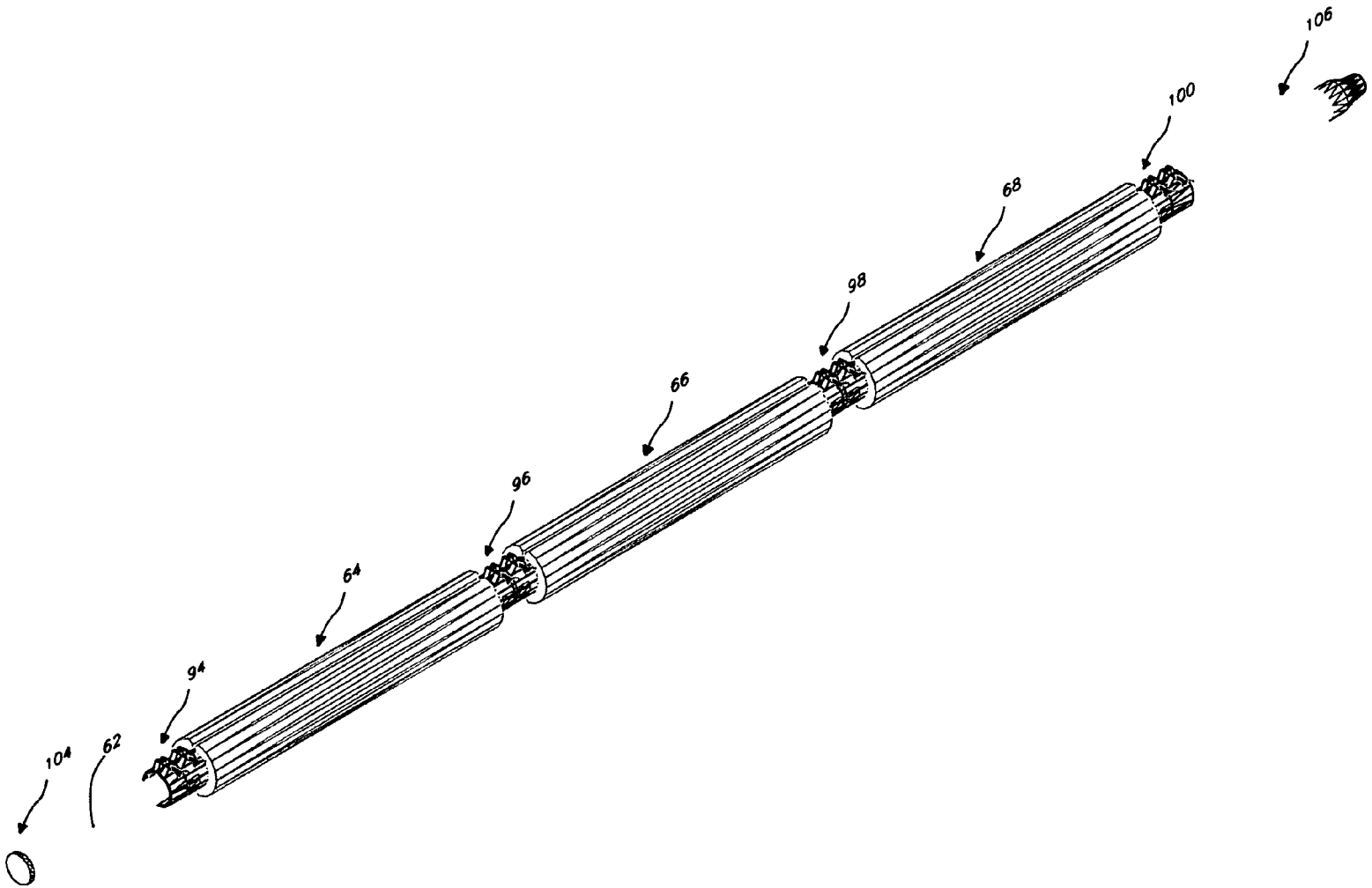
FIG. 5 is an isometric assembled view of the floatation modules of FIG. 4 shown clamped about a joint of the land string.

Referring now to FIG. 5, an isometric assembled view of the floatation modules of FIG. 4 shown clamped about a joint of the landing string 62 will now be described. More specifically, the floatation module 64 has been engaged to the landing string 62 via the clamp means 94 and clamp means 96. The floatation module 66 has been engaged to the landing string 62 via the clamp means 96 and clamp means 98. The floatation module 68 has been engaged to the landing string 62 via the clamp means 98 and clamp means 100. Hence, the buoyant landing string 62, as seen in FIG. 5, and can now be run into the marine riser using convention means known to those of ordinary skill in the art.

Figure 6:
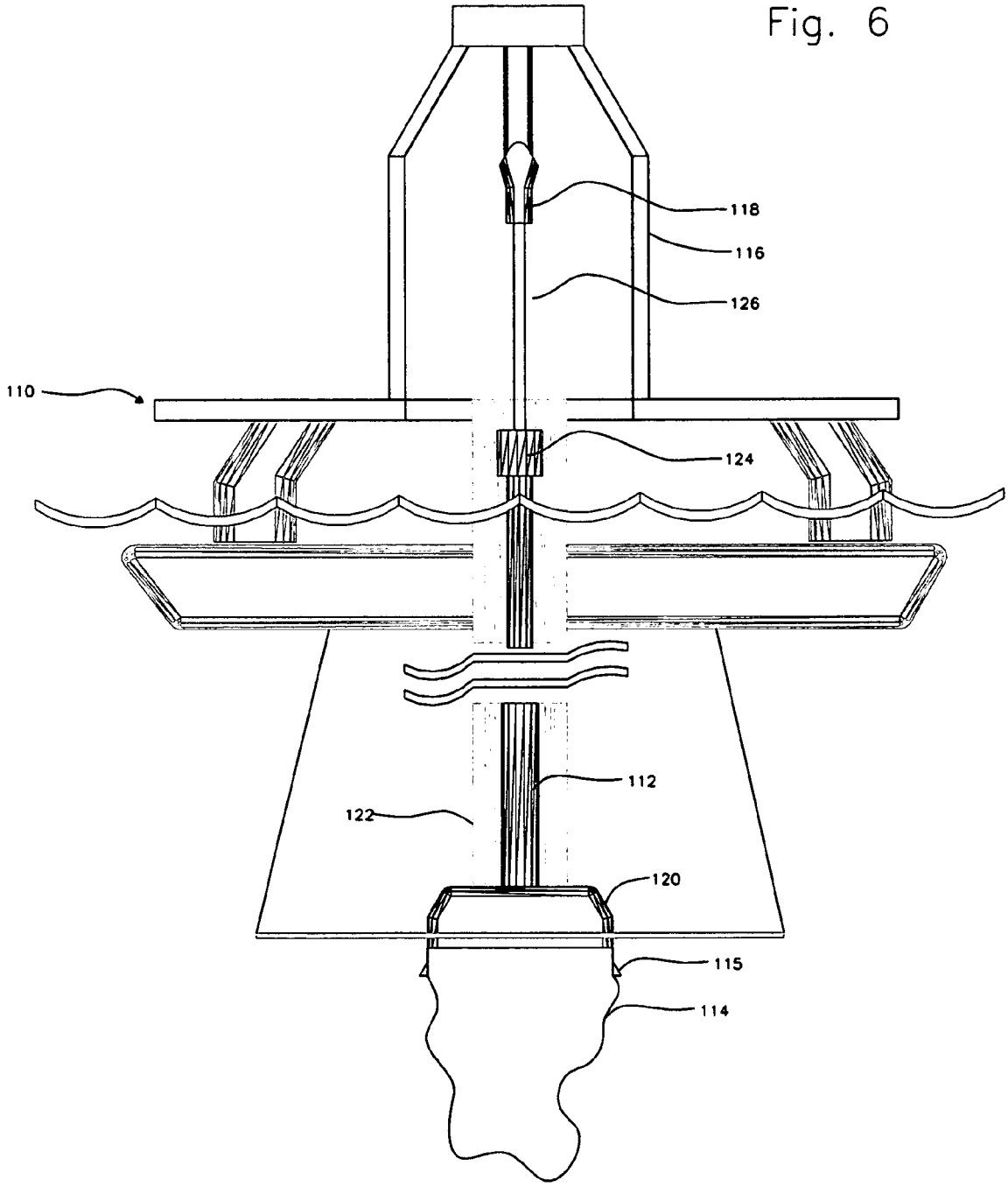
FIG. 6 is a schematic view of the floating platform lowering a tubular string into a well in accordance with the teachings of the present invention.

In FIG. 6, a schematic view of a floating platform 110 lowering a tubular string 112 into a well 114 in accordance with the teachings of the present invention will now be described. FIG. 6 shows a surface casing 115 already cemented into place in the earth's surface, as understood by those of ordinary skill in the art. The tubular string 112 being lowered, in one preferred embodiment, will be a casing string 112, and the floating platform 110 will contain a drilling rig 116. The drilling rig 116 will contain a hoisting system that includes the block 118. A sub-sea well head 120 is position on the ocean floor, and wherein a marine riser 122 extends from the sub-sea well head 120 on the ocean floor to the floating platform 110. It should be noted that the tubular string 112 can also be, in one embodiment, a production assembly for producing hydrocarbons or a testing assembly for testing the well.

The method of landing a casing string 112 into a sub-sea well head 120 from the floating platform 110 includes running the casing string 112 into the marine riser 122 and connecting a casing hanger 124 to the casing string 112. A casing hangar 124 is a device that serves to land and anchor to the casing string inside the sub-sea well head 120. Casing hangers are commercially available from FMC Inc. under the name casing hangers.

The method further includes attaching the landing string 126 to the casing hanger 124. As noted earlier, the landing string 126 is a tubular member that is used to lower into proper position a down hole component, and wherein the down hole component may be a casing string, bottom hole assembly containing a measurement while drilling tool with bit and mud motor, production and testing assemblies, etc. The landing string 126 may be referred to sometimes as a work string. In some embodiments, the landing string 126 is a specially designed and/or sized drill pipe.

Figure 7:
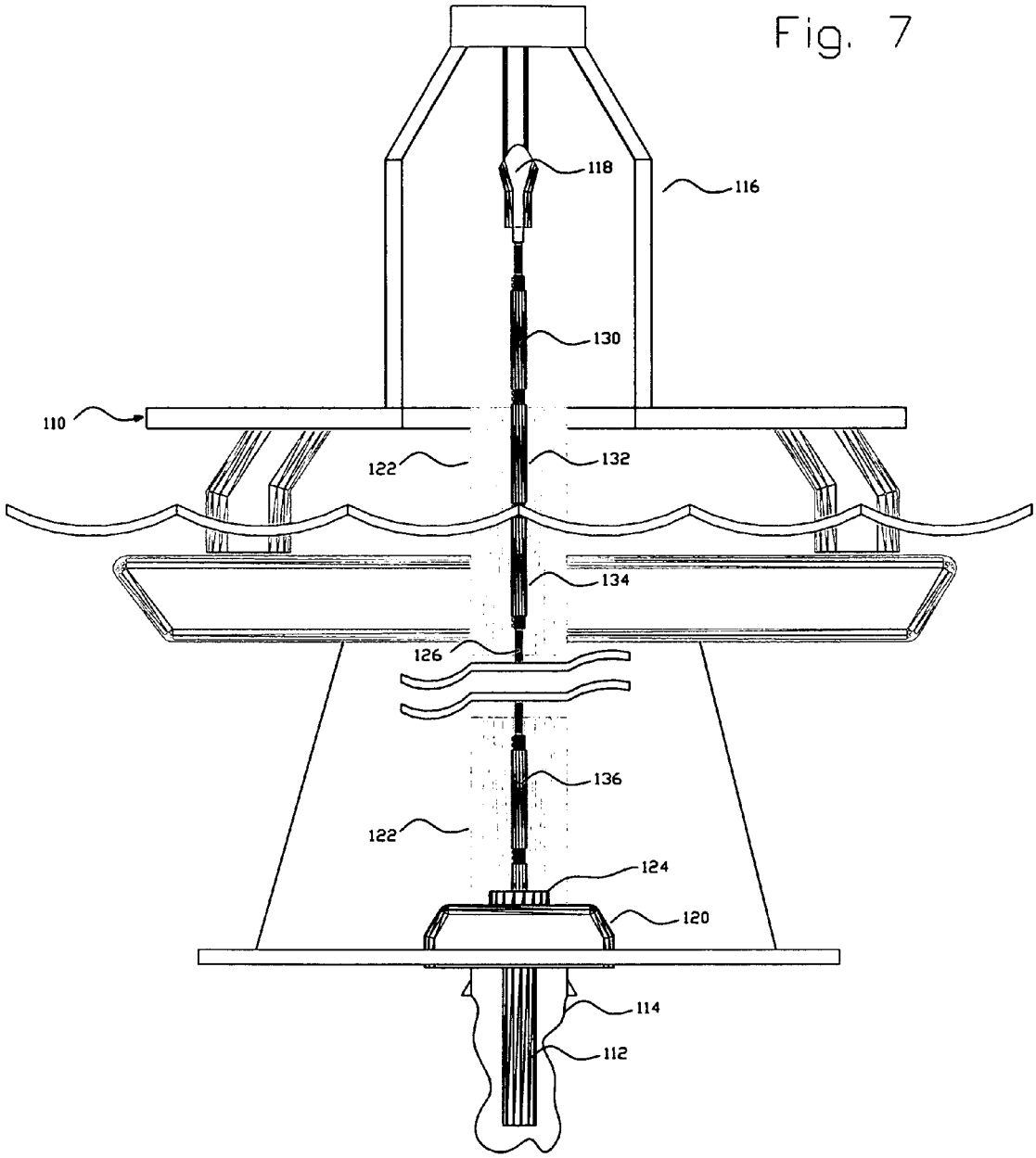
FIG. 7 is a sequential schematic view of the floating platform seen in FIG. 6 wherein the tubular string has been lowered to a predetermined depth.

The method includes connecting a buoyancy module, such as the floatation modules 64, 66 and 68 noted in FIG. 4, to the landing string 126. The operator would thereafter lower the landing string 126 (containing the floatation modules) through the marine riser 122. Since the marine riser 122 will have a fluid therein, the weight of the tubular string 112 being lowered into the marine riser 122 will be reduced, according to the teachings of this invention. Next, and as seen in FIG. 7, the casing hanger 124 can be landed into the sub-sea well head 120. A plurality of floatation modules, including 130, 132, 134, 136, are shown clamped about the landing string 126. Hence, the casing string 112 has been lowered to a predetermined depth safely by reducing the rig hoisting requirements.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. A method of landing a casing string into a sub-sea well head from a floating drilling rig, wherein a marine riser connects the rig to the sub-sea well head, and a well extends from the sub-sea well head into the earth's surface, the method comprising:

running the casing string into the marine riser;

connecting a casing hanger to said casing string;

lowering the casing string into the well;

attaching a landing string to said casing hanger;

connecting a floatation module to the landing string;

lowering the landing string through the marine riser;

reducing the weight of the casing string being lowered into the marine riser due to buoyancy effect provided by the floatation module;

landing the casing hanger into the sub-sea well head;

wherein said floatation module comprises: a tubular member having a buoyant material bonded thereto; a slot formed within said tubular member; and engagement means for engaging with the slot; and, the step of connecting the floatation module to the landing string includes:

attaching the engagement means with the slot in order to clamp said floatation module with the landing string.

2. The method of claim 1 wherein said engagement means comprises a die member and wherein the step of attaching the engagement means further comprises:

engaging the die member into said slot.

3. An apparatus for reducing the load applied to a rig positioned over a well that extends into the earth's surface, the rig utilizing a marine riser connected to a sub-sea tree, and wherein the sub-sea tree is connected to the well, with the well having a tubular string disposed therein, the apparatus comprising:

a landing string connected to the tubular string, and wherein the landing string is suspended from the rig within the marine riser;

a floatation module attached to the landing string, wherein said floatation module comprises a tubular sleeve having buoyant material applied thereto, wherein said buoyant material comprises a foam bonded to said tubular sleeve and wherein the load of the landing string and the tubular string is reduced by the attachment of said floatation module when said floatation module is within the marine riser; and, a clamp configured to engage the floatation module to the landing string, wherein said tubular sleeve contains a plurality of slots formed therein and cooperating with said clamp.

4. The apparatus of claim 3 wherein said tubular sleeve comprises a first cylindrical half body and a second cylindrical half body.

5. The apparatus of claim 4 wherein said clamp comprises a first shell attached to a second shell, and wherein said first shell and said second shell are pivotly attached to form a cylindrical member.

6. The apparatus of claim 5 wherein said tubular string is selected from the group consisting of: a casing string, a production assembly, or a testing string.

7. The apparatus of claim 5 wherein said clamp further comprises a first set of dies adapted to engage the slots of the tubular sleeve.

8. The apparatus of claim 7 wherein a second floatation module is attached to said landing string and wherein said clamp further comprises a second set of dies adapted to engage a second plurality of slots located in said second floatation module.

9. The apparatus of claim 5 wherein said first shell comprises a latching rod and said second shell comprises a latching protrusion and wherein said latching rod is configured to engage said latching protrusion in order to latch said first shell and said second shell together.

* * * * *